United States Patent [19]

Gill et al.

[11] 4,354,623

[45] Oct. 19, 1982

[54] HEAVY DUTY TUBE WRINGING DEVICE

[76] Inventors: John B. Gill; Dorothy E. Gill, both of 519 Shire Ct., Eugene, Oreg. 97401

[21] Appl. No.: 166,488

[22] Filed: Jul. 7, 1980

[51] Int. Cl.[3] ..... B65D 35/28

[52] U.S. Cl. ..... 222/102; 222/105

[58] Field of Search ..... 222/102, 106, 101, 103, 222/105, 104

[56] References Cited

U.S. PATENT DOCUMENTS

| | | | |
|---|---|---|---|
| 1,688,512 | 10/1928 | Walker | 222/102 |
| 1,845,291 | 2/1932 | Koontz | 222/102 |
| 2,357,351 | 5/1944 | Oliver | 222/102 |
| 2,496,004 | 1/1950 | Geyer | 222/102 |
| 3,248,013 | 4/1966 | Bekhor | 222/101 |
| 3,297,205 | 1/1967 | Sumner | 222/102 |
| 3,586,213 | 6/1971 | Gill | 222/102 |
| 4,205,764 | 6/1980 | Gill | 222/105 |

*Primary Examiner*—Robert J. Spar

*Assistant Examiner*—Patricia Ray

*Attorney, Agent, or Firm*—James D. Givnan, Jr.

[57] ABSTRACT

A device for progressively collapsing large size tubular containers, the device including a handgrip on which is fixedly mounted a frame of a pair of frames with the remaining frame adapted for pivoted opening and closing movement relative the mounted frame. Each frame carries a corrugated roller which mesh with one another and upon rotation collapse a tube passing therebetween. A lever and roller clutch impart unidirectional rotation to the rollers. Cantilever bearings support the rollers and are of a resilient nature to permit displacement of the roller axes while biasing the rollers toward one another and the intermediate tube wall. Roller configuration includes ridges and grooves terminating in surfaces formed on like radii to provide a progressive wedging action on the tube wall. A handgrip is provided which, along with the lever, provides convenient manual control of the tubular container.

7 Claims, 4 Drawing Figures

HEAVY DUTY TUBE WRINGING DEVICE

BACKGROUND OF THE INVENTION

The present invention concerns a manually operated roller device for progressively collapsing tubular containers to expel their viscous contents.

The present tube wringing device is somewhat analogous to that disclosed and claimed in my earlier U.S. Pat. No. 3,586,213 and a like device disclosed in U.S. Pat. No. 4,205,764 also issued to the present inventor.

In the prior art, as evidenced by the foregoing patents, is a tube wringing device utilizing a pair of cooperating gear-like rollers which jointly act on a collapsible tube to compress same to effect tube discharge. Each roller is carried by a handle frame which frames are pivotally connected for opening and closing movement about a common axis during tube installation and removal. One of said rollers is provided with a turnkey extension by which rotation is imparted to the intermeshed rollers to move a tube therepast with consequent tube flattening. The first mentioned patent relies on manual pressure to retain the rollers in operative, tube collapsing engagement while the second patent discloses a holder for a tube squeezing device which holder includes a latch for adjusted biased engagement with a tube wringer handle. In both patent disclosures, the rollers are rigidly journaled within their respective handle frames. Slight displacement of the rollers is permitted by reason of manual collapsing of the device or a yieldably mounted latch member in the second mentioned patent. While both of the previously disclosed tube wringing devices and the holder for same fulfill their intended purposes, such devices are not suitable for collapsing relatively large tubular containers such as are used for caulking compound, etc. Such tubes are about two inches in diameter and of metal, typically dented or wrinkled to some degree during handling. While slotted keys are available to the purchaser, it is extremely difficult to roll up the tube in view of caulking viscosity and the heavy tube body. Accordingly, a considerable amount of wasted caulking remains within every caulking tube at the completion of its manual squeezing or rolling. The same is true of heavy gauge plastic tubes used for a variety of viscous materials. Previous tube collapsing devices by reason of roller groove configuration are not capable of collapsing such thick walled tubes.

A further disadvantage of using such tubes is the difficulty in running a continuous, uniform bead important to a neat caulking application. Manual squeezing or key rolling of the tube results in unpredictable and uneven tube discharge.

SUMMARY OF THE PRESENT INVENTION

The present invention is embodied within a tube wringing device having yieldably mounted rollers which are biased into tube engagement by stationary frame members.

A pair of like rollers are utilized having irregular or fluted surfaces which progressively apply a wedging action on the tube wall during tube collapsing. Constant roller pressure against the interposed tube is effected by flexible roller bearings. The rollers are mounted in frames one mounted on a handgrip with the remaining frame adapted for opening and closing movement during tube installation or withdrawal from between the rollers. Handle mounted retainer means are adjustable to permit varying of roller pressure. A lever at the end of one of said rollers desirably includes a unidirectional clutch for convenient and forceful roller actuation.

Important objects include the provision of a tube wringing device particularly suited for collapsing large, heavy duty tubular containers enabling precisely controlled discharge therefrom all in a highly convenient manner; the provision of a tube wringing device which virtually fully collapses large size metal and plastic tubes to expel virtually all of their contents over a period of time to avoid waste resulting from hit-and-miss collapsing of the tube by manual squeezing or tube rolling with a slotted key; the provision of a tube wringing device wherein the grooved rollers have correspondingly shaped ridges and grooves which avoid trapping pockets of tube contents; the provision of a tube wringing device having rollers with ridges and grooves formed on like radii to exert a continuous wedging action on tube contents; the provision of a tube wringing device which collapses the tube without pinching or rupturing of the tube wall; the provision of a tube wringing device having replaceable roller carrying bearings of a yieldable nature; the provision of a tube wringing device including a unidirectional roller type clutch for driving a roller by reciprocation of a hand operated lever; the provision of a tube wringing device including retainer means facilitating quick release of a roller frame to expedite installation of a fresh tube; the provision of a tube wringing device having rollers which operate in step-like fashion to resist rotational forces imparted to same by a pressurized elastic tube wall to prevent tube movement during clutch overrunning.

DETAILED DESCRIPTION OF THE PREFERRED EMBODIMENT

Figure 2:
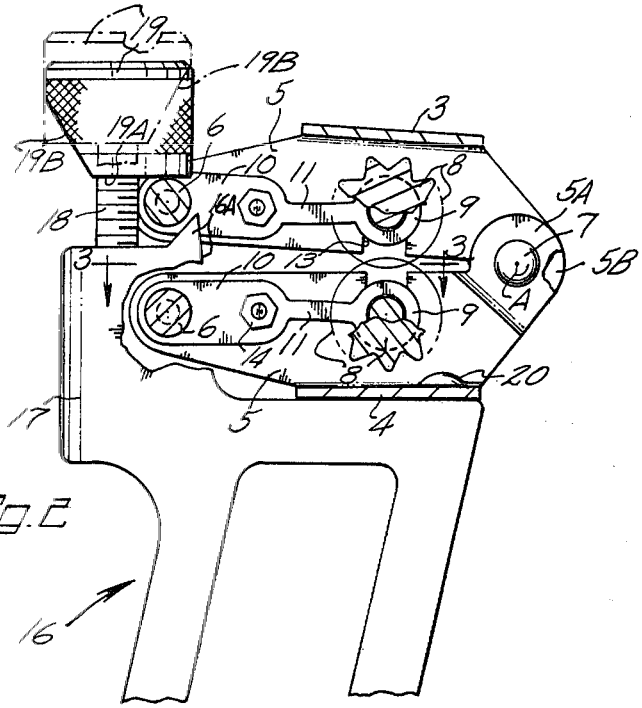
FIG. 2 is a vertical sectional view taken approximately along line 2—2 of FIG. 1.
Figure 3:
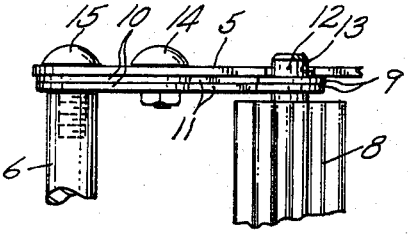
FIG. 3 is a view taken downwardly approximately along line 3—3 of FIG. 2.

With continuing attention to the drawing, applied reference numerals 1 and 2 indicate a pair of swingably interconnected frames. Each frame includes roller guards at 3 and 4, as best viewed in FIG. 2, and rearwardly extending pairs of side members 5. Each frame's side members are interconnected by means of cross-members 6. The forward ends of the frame side members terminate in overlapped ears 5A and 5B through which pass a spaced apart pair of aligned pivots 7. From this it will be seen that the uppermost frame is adapted for opening and closing movement about an axis A of said pivots to admit the end of a tubular container T.

A tube compressing roller at 8 is carried by each frame by means of cantilever bearings 9 formed as part of bearing plates 10. A plate arm segment at 11 is of reduced section with inherent resiliency to yield under operational loads imparted to the bearings 9 by roller trunions at 12. Such relative frame-roller movement is permitted by frame openings 13. The bearing plates at 10 are secured to each side member of frames 1 and 2 by fastener assemblies at 14 and by threaded fasteners at 15 extending through the frame side member, through spring plate apertures and terminating in threaded engagement with a crossmember 6. Plates 10 are used in pairs to permit low cost plate manufacture as by a stamping operation.

A handgrip constituting a base is indicated generally at 16 and includes a boss 17 integral therewith which is apertured at 17A to receive a crossmember 6 in a friction tight fit. A machine screw 20 completes frame attachment. Boss 17 defines an internally threaded upright bore within which is received a threaded stud 18 having a crossmember retainer 19 at its upper end. The underside 19A of the retainer is adapted for biased engagement with uppermost crossmember 6 to bias or urge same and the uppermost roller carried thereby into downward tube engagement. Advancement of retainer 19 toward boss 17 increases roller loading. To facilitate rapid relase of crossmember 6, retainer 19 has a canted surface 19B which may be disposed over the crossmember thereby permitting upward crossmember passage therepast to avoid accentuated vertical movement of vertical retainer 19. A deflector 16A on boss 17 serves to redirect the advancing folded edge of the tube.

Figure 1:
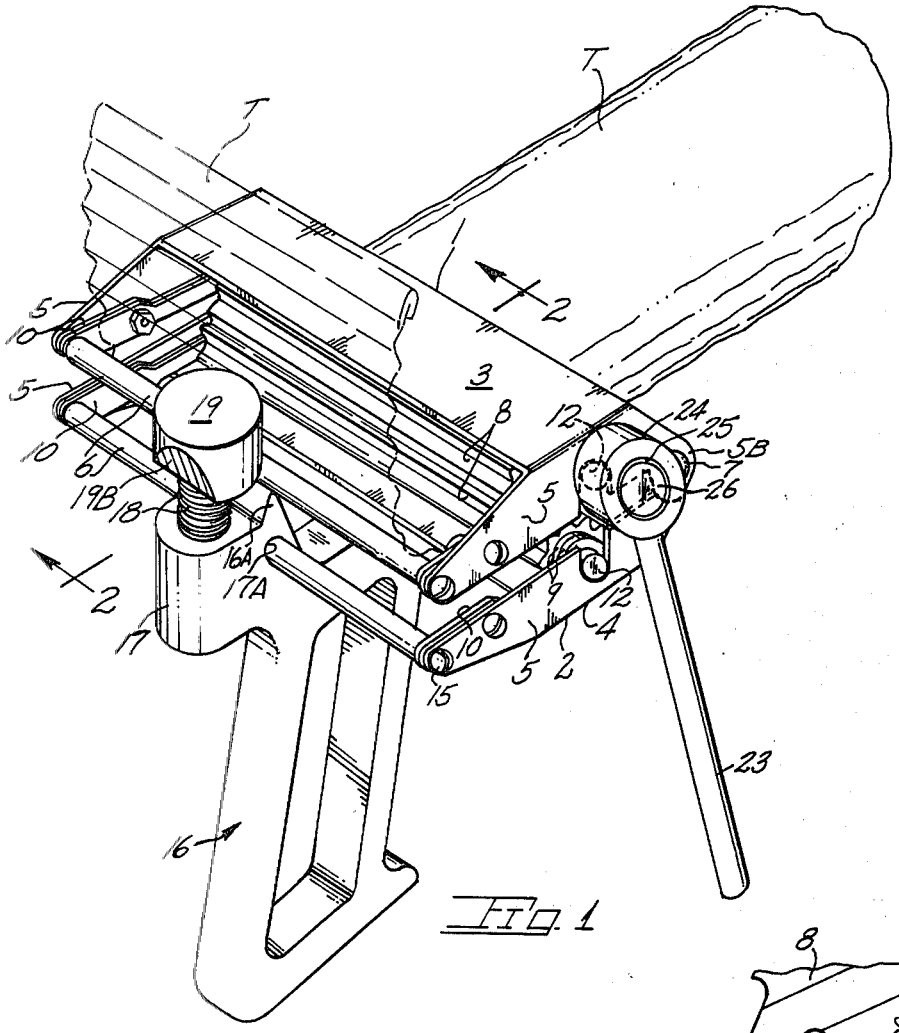
FIG. 1 is a downward perspective view of the present device operatively disposed with a collapsible tube segment therein.
Figure 4:
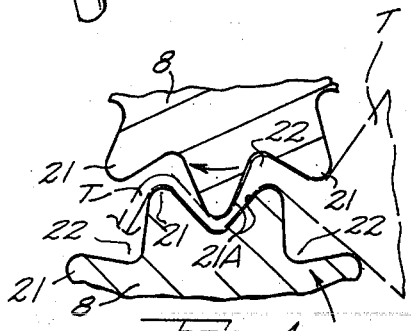
FIG. 4 is a vertical sectional view of cooperating roller fragments of the present device.

With attention now to the pairs of rollers at 8 which are yieldably mounted in cantilever bearings 9 said rollers are of a fluted or corrugated shape in section each having a series of ridges 21 and a series of grooves 22 the arcuate terminuses of which are preferably formed on like radii with zero clearance therebetween when the tubular container is removed. As viewed in FIG. 4, roller rotation causes ridge surfaces 21A to exert a progressive wedging action on the flattened tube walls to fully displace tube contents from therebetween. Use of conventional or typical gear tooth configurations would not effect uniform progressive tube collapsing by reason of ridges and groove radii being different to provide clearance necessary for smooth gear meshing. A suitable terminous radius of 0.031 thousandths of an inch has proved suitable on the ridges and grooves with roller diameter of 0.750 thousandths of an inch with a root diameter of 0.500 thousandths of an inch with a circular pitch of forty degrees.

Manually actuated means such as a lever at 23 has an enlarged end 24 within which a roller clutch 25 is housed the rollers of which engage an enlarged trunnion 26 integral with a roller end. Oscillation of lever 23 imparts unidirectional rotation to said roller and, of course, the meshed remaining roller to draw the tube therepast. Such a roller clutch is manufactured by the Torrington Corporation.

In use, the frames are parted to permit installation of the tube folded end intermediate the rollers whereupon crossmember 6 of the upper frame is swung downwardly into place above boss 17. Advancement of retainer 19 causes surface 19A thereof to bias the crossmember, frame and roller thereon downwardly for roller coaction on tube T.

Of interest when collapsing a tube made of elastic wall material, such as is commonly used for products sold under the registered trademark DAP, is that the present roller sectional configuration prevents wall rupture and further undesired reverse roller rotation by a pressurized, elastic tube wall. During lever operation incremental stepping action occurs as the rollers rotate past a ridge and groove centered position (the FIG. 4 position) and into a seated or closer relationship where opposing roller wall surfaces at 21A are parallel whereat the rollers remain static regardless of the tube exerted forces. Stated otherwise, maximum roller separation occurs at ridge and groove centering (FIG. 4) with minimum roller separation occurring when walls 21A are parallel which in effect is a self-locking position overcome only by further lever operation. Accordingly, during overrunning of the roller clutch during forward lever movement the tube is prevented from outward movement by action of the highly pressurized tube tensioned tube walls acting on frontal roller surfaces. Accordingly, tube pressure may be utilized to propel a bead of tube contents of some length without continuous lever operation.

The bearing plates 10, after long use in an abrasive environment such as when the wringer is used to collapse tubes of dental impression material, may be replaced simply by removal of fasteners 14 and 15 from each side member. The bearings are inexpensively produced from spring steel by a stamping operation.

While we have shown but one embodiment of the invention it will be apparent to those skilled in the art that the invention may be embodied still otherwise without departing from the spirit and scope of the invention.

Having thus described the invention, what is desired to be secured under a Letters Patent is:

We claim:

1. A device for progressively wringing a collapsible tubular container, said device comprising, a base, frames pivotally interconnected at their corresponding ends with one of said frames fixed in place on said base, each of said frames having a cross member and spaced apart opposing side members, rollers one each resiliently carried by said frames and having intermeshing surfaces which are adapted to coact on the collapsible tubular container positioned therebetween to progressively collapse same to expel tube contents, bearing plates in place on each of said frames and mounting said rollers on said frames, each of said bearing plates having a flexible arm segment to yieldably mount the ends of said rollers, each of said bearing plates being mounted in juxtaposed parallel relationship with an adjacent frame side member, removable fasteners attaching said bearing plates to said opposing side members of each of the frames permitting removal and replacement of worn bearing plates, and manually actuated means supported at the end of one of said rollers to enable rotation of the roller and the coacting roller to jointly act on the tubular container therebetween.

2. The device claimed in claim 1 wherein a retainer is in adjustable threaded engagement with the base and wherein the retainer has a canted wall surface to facilitate upward release of the other of said frames.

3. The device claimed in claim 1 wherein said manually actuated means is a lever, roller clutch means actuated by said lever and imparting unidirectional rotation to a clutch supporting roller.

4. The device claimed in claim 1 wherein said plates are disposed in pairs with each pair adjacent a frame side member.

5. The device claimed in claim 1 wherein the intermeshing surfaces of said rollers have like outside and root diameters with ridges and grooves for meshing with one another during tube collapsing, said ridges and grooves formed on like radii to provide corresponding surfaces which exert a progressive wedging action on the tube walls to fully collapse the tubular container and displace the tube contents from intermediate the walls.

6. The device claimed in claim 1 wherein said frames define openings within which the ends of said rollers are received, the openings being of greater size than the roller ends to permit relative movement therebetween.

7. The device claimed in claim 1 wherein said bearing plates each have a cantilevered arm segment of reduced section for bearing flexibility.

* * * * *